US009546656B2

(12) United States Patent
Nakamura et al.

(10) Patent No.: US 9,546,656 B2
(45) Date of Patent: Jan. 17, 2017

(54) FLUID MACHINE

(75) Inventors: Shinji Nakamura, Isesaki (JP); Hirofumi Wada, Isesaki (JP); Yuuta Tanaka, Isesaki (JP); Yasuhiro Furusawa, Isesaki (JP)

(73) Assignee: SANDEN HOLDINGS CORPORATION, Isesaki-shi (JP)

( * ) Notice: Subject to any disclaimer, the term of this patent is extended or adjusted under 35 U.S.C. 154(b) by 355 days.

(21) Appl. No.: 14/126,128

(22) PCT Filed: Jun. 12, 2012

(86) PCT No.: PCT/JP2012/065038
§ 371 (c)(1),
(2), (4) Date: Dec. 13, 2013

(87) PCT Pub. No.: WO2012/173123
PCT Pub. Date: Dec. 20, 2012

(65) Prior Publication Data

US 2014/0134034 A1 May 15, 2014

(30) Foreign Application Priority Data

Jun. 13, 2011 (JP) ..... 2011-131025

(51) Int. Cl.
*F01C 1/063* (2006.01)
*F04C 15/00* (2006.01)
(Continued)

(52) U.S. Cl.
CPC ..... *F04C 15/0061* (2013.01); *F01C 1/0215* (2013.01); *F01C 13/04* (2013.01);
(Continued)

(58) Field of Classification Search
CPC ..... F01C 13/04; F01C 21/02; F01C 21/10; F01C 1/0215; F01C 21/008; F01C 17/06; F01C 1/18; F01C 21/007; F04C 23/02; F04C 15/0061; F04C 18/0215; F04C 2240/60; F04C 2240/70
(Continued)

(56) References Cited

U.S. PATENT DOCUMENTS 4,900,238 A 2/1990 Shigemi et al.
2003/0223898 A1 12/2003 Fujioka et al.
(Continued)

FOREIGN PATENT DOCUMENTS

CN 88102057 10/1988
CN 101354033 1/2009
(Continued)

OTHER PUBLICATIONS

Search Report dated Jan. 7, 2015 which issued in the corresponding European Patent Application No. 12800188.0.
(Continued)

*Primary Examiner* — Thomas Denion
*Assistant Examiner* — Thomas Olszewski
(74) *Attorney, Agent, or Firm* — Cozen O'Connor

(57) ABSTRACT

The present invention relates to a fluid machine. A pump integrated expander (29A) includes a pump unit (60) and an expansion unit (50). In the pump unit (60), a casing member (65) supports a gear pump (61), a rotating shaft (28) and a driven crank mechanism (81). In the expansion unit (50), a casing including a main body (51*a*) and a casing member (54) supports an expander (23) including a fixed scroll (51) and an orbiting scroll (52). The pump integrated expander (29A) is divided into the pump unit (60) and the expansion unit (50) by separating at the fitted portion of a tubular portion (65*c*) on the pump unit (60) side and a smaller inner diameter portion (54*b*) on the expansion unit (50) side and by pulling the eccentric bush (83) out of a drive bearing (56).

3 Claims, 6 Drawing Sheets

(51) Int. Cl.

| | |
|---|---|
| ***F01C 13/04*** | (2006.01) |
| ***F01C 21/02*** | (2006.01) |
| ***F01C 21/10*** | (2006.01) |
| ***F04C 23/02*** | (2006.01) |
| ***F01C 1/02*** | (2006.01) |
| ***F04C 18/02*** | (2006.01) |
| ***F01C 21/00*** | (2006.01) |
| *F01C 17/06* | (2006.01) |
| *F01C 1/18* | (2006.01) |

(52) U.S. Cl.
CPC ..... *F01C 21/008* (2013.01); *F01C 21/02* (2013.01); *F01C 21/10* (2013.01); *F04C 18/0215* (2013.01); *F04C 23/02* (2013.01); *F01C 1/18* (2013.01); *F01C 17/06* (2013.01); *F01C 21/007* (2013.01); *F04C 2240/60* (2013.01); *F04C 2240/70* (2013.01)

(58) Field of Classification Search
USPC ..... 418/55.1, 55.2, 55.5, 55.6, 89, 99, 94
See application file for complete search history.

(56) References Cited

U.S. PATENT DOCUMENTS

| | | | | |
|---|---|---|---|---|
| 2006/0159580 | A1* | 7/2006 | Matsuhashi | 418/55.2 |
| 2007/0178002 | A1* | 8/2007 | Hiwata et al. | 418/55.2 |
| 2011/0142695 | A1* | 6/2011 | Taguchi et al. | 417/410.1 |
| 2012/0019010 | A1 | 1/2012 | Nakamura et al. | |
| 2013/0017114 | A1 | 1/2013 | Nakamura et al. | |

FOREIGN PATENT DOCUMENTS

| | | | | |
|---|---|---|---|---|
| EP | 0 324 645 | | 7/1989 | |
| JP | 61-116089 | | 6/1986 | |
| JP | 8-144969 | | 6/1996 | |
| JP | 2006-342793 | | 12/2006 | |
| JP | 2010077827 | A * | 12/2006 | F01C 1/02 |
| JP | 2007-170227 | | 7/2007 | |
| JP | 2007170227 | A * | 7/2007 | F04C 18/02 |
| JP | 2008-240597 | | 10/2008 | |
| JP | 2010-013979 | | 1/2010 | |
| JP | 2010-71226 | | 4/2010 | |
| JP | 2010-077827 | | 4/2010 | |
| JP | 2010-249130 | | 11/2010 | |
| JP | 2010249130 | A * | 11/2010 | F01C 13/04 |
| JP | 2011-032958 | | 2/2011 | |
| JP | 2011-99362 | | 5/2011 | |
| WO | WO 2010/109875 | | 9/2010 | |

OTHER PUBLICATIONS

Office Action (and a partial English translation thereof) dated Jan. 14, 2014 issued in the corresponding Japanese Patent Application No. 2011-131025.

* cited by examiner

FLUID MACHINE

RELATED APPLICATIONS

This application is a U.S. National Phase Application under 35 USC 371 of International Application PCT/JP2012/065038 filed Jun. 12, 2012.

This application claims the priority of Japanese application No. 2011-131025 filed Jun. 13, 2011, the entire content of which is hereby incorporated by reference.

TECHNICAL FIELD

The present invention relates to a fluid machine that includes a first rotating unit, a second rotating unit, and a driven crank mechanism.

BACKGROUND ART

Conventionally, for example, as a fluid machine incorporated into a Rankine cycle device that recovers and reuses waste heat of a vehicle engine, a pump integrated expander, in which a pump that circulates working fluid such as refrigerant is integrally connected with a scroll type expander that expands heated and evaporated fluid, is known (see, for example, the Patent Document 1).

Furthermore, there is known a fluid machine integrally equipped with a plurality of rotating units as the pump integrated expander, in which machine an Oldham coupling is disposed between the plurality of rotating units, to separate each rotating unit at the Oldham coupling, so that an operation evaluation of each rotating unit can be performed individually (see, for example, the Patent Document 2).

CITATION LIST

Patent Documents

Patent Document 1: Japanese Laid-open Patent Application Publication No. 2010-077827

Patent Document 2: Japanese Laid-open Patent Application Publication No. 2010-249130

SUMMARY OF THE INVENTION

Problems to be Solved by the Invention

However, since the rotating units are configured to be separated from each other at a coupling disposed on a main shaft, problems may arise in that it may be necessary to provide a bearing for the main shaft to every separated rotating unit, and thus, a length of the fluid machine in an axial direction might be increased, and the number of components and the number of man hours needed to process and assemble the machine might be increased, resulting in an increase in production cost, and the like.

Thus, an object of the present invention is to provide a fluid machine that allows an individual operation evaluation of each rotating unit to be performed, and achieves the shortened length in the axial direction, and the decreased number of components and the decreased number of man hours needed to process and assemble the machine.

Means for Solving the Problems

In order to achieve the object, a fluid machine according to an aspect of the present invention includes: a first rotating unit that rotates about a main shaft; a second rotating unit that includes a fixed scroll, an orbiting scroll and a rotation restricting mechanism; and a driven crank mechanism that is disposed between the main shaft and the orbiting scroll, converts between rotational motion of the main shaft and orbiting motion of the orbiting scroll, and is capable of changing an orbiting radius of the orbiting scroll, in which a first casing supports the first rotating unit and supports the driven crank mechanism via the main shaft, in which a second casing supports the second rotating unit, and in which the first casing and the second casing are capable of being separated from each other.

Effect of the Invention

According to the fluid machine of the aspect of the present invention, by separating the first casing and the second casing, operation evaluations of the first casing and the second casing can be performed individually, and furthermore, since the first casing supports the driven crank mechanism via the main shaft while supporting the first rotating unit, it is not necessary to provide a bearing for the main shaft on the second casing side, and thus, the length of the fluid machine in the axial direction can be shortened and the number of components and the number of man hours needed to process and assemble of the machine can be decreased.

MODE FOR CARRYING OUT THE INVENTION

Hereunder, embodiments of the present invention will be described in detail with reference to the accompanying drawings.

Figure 1:
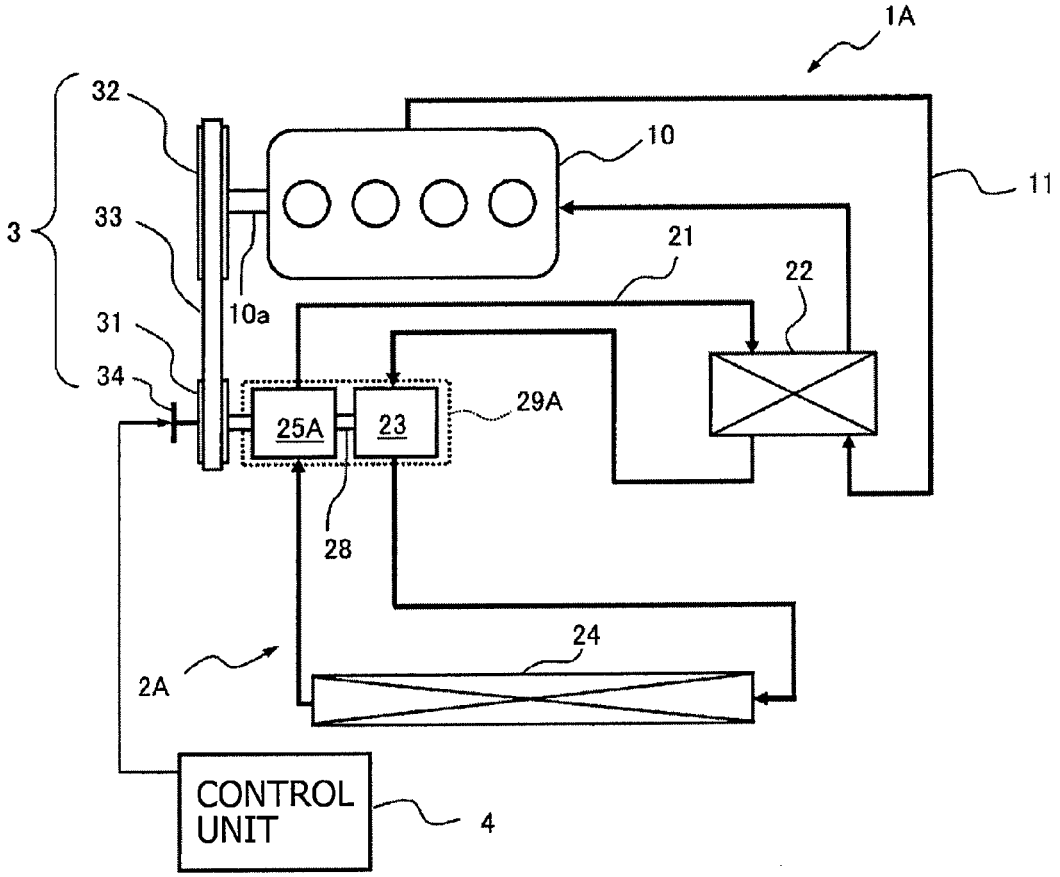
FIG. 1 is a view illustrating a schematic configuration of a waste-heat reusing device according to a first embodiment of the present invention.

FIG. 1 illustrates a configuration of a waste-heat reusing device 1A, into which a fluid machine according to a first embodiment of the present invention is incorporated.

The waste-heat reusing device 1A is a device mounted on a vehicle together with an engine 10, to recover and reuse waste heat of the engine 10.

The waste-heat reusing device 1A includes a Rankine cycle device 2A, a transmission mechanism 3 that transmits an output of the Rankine cycle device 2A to the engine 10, and a control unit 4.

The engine 10 is an internal combustion engine provided with a water-cooled cooling device, the cooling device including a cooling water circulation passage 11 that circulates cooling water.

In the cooling water circulation passage 11, an evaporator 22 of the Rankine cycle device 2A is disposed.

The Rankine cycle device 2A recovers the waste heat of the engine 10 from the cooling water of the engine 10, and converts the recovered heat to a drive force, to output the drive force.

The Rankine cycle device 2A includes a circulation passage 21 that circulates working fluid. In the circulation passage 21, the evaporator 22, an expander 23, a condenser 24 and a pump 25A are disposed in this order along a flow direction of the working fluid.

The evaporator 22 absorbs heat from the engine 10, to allow heat exchange between high-temperature cooling water flowing through the cooling water circulation passage 11 and the working fluid of the Rankine cycle device 2A to occur, so as to heat and evaporate (vaporize) the working fluid.

The expander 23 is a scroll type expander that expands the working fluid vapor vaporized in the evaporator 22, to produce the drive force.

The condenser 24 allows heat exchange between the working fluid which has passed through the expander 23 and outside air to occur, to cool and condense (liquefy) the working fluid.

The pump 25A is a mechanical pump, and the pump 25A pumps the working fluid liquefied in the condenser 24 to the evaporator 22.

Thus, the working fluid is circulated through the circulation passage 21 repeating the vaporization, the expansion and the condensation.

In this case, the expander 23 and the pump 25A are connected and integrated by a rotating shaft 28, to provide a pump integrated expander 29A (fluid machine). That is, the rotating shaft 28 of the pump integrated expander 29A acts as an output shaft of the expander 23 and a drive shaft of the pump 25A.

Then, first, the output of the engine 10 drives the pump 25A (pump unit in the pump integrated expander 29A) to start up the Rankine cycle device 2A, and then, when the expander 23 (expansion unit in the pump integrated expander 29A) starts to produce a sufficient drive force, the drive force of the expander 23 drives the pump 25A.

The transmission mechanism 3 transmits a torque (shaft torque) of the pump integrated expander 29A, that is an output of the Rankine cycle device 2A, to the engine 10, and at the time of starting up the Rankine cycle device 2A, the transmission mechanism 3 transmits an output torque of the engine 10 to the pump integrated expander 29A (pump unit).

The transmission mechanism 3 includes a pulley 31 attached to the rotating shaft 28 of the pump integrated expander 29A, a crank pulley 32 attached to a crank shaft 10*a* of the engine 10, a belt 33 wrapped around the pulley 31 and the crank pulley 32, and an electromagnetic clutch 34 disposed between the rotating shaft 28 of the pump integrated expander 29A and the pulley 31.

Furthermore, by turning on (engage) or off (disengage) the electromagnetic clutch 34, the drive force can be transmitted or cut off between the engine 10 (crank shaft 10*a*) and the Rankine cycle device 2A (rotating shaft 28 of the pump integrated expander 29A).

The control unit 4 has a function of controlling operation of the electromagnetic clutch 34 (turn-on (engagement) and turn-off (disengagement)), and by the on and off control of the electromagnetic clutch 34, operation and stop of the Rankine cycle device 2A are controlled.

That is, when the control unit 4 determines that an operating condition of the Rankine cycle device 2A has been satisfied, the control unit 4 engages (turns on) the electromagnetic clutch 34, to make the engine 10 operate the pump 25A (pump unit of the pump integrated expander 29A), so that the circulation of the working fluid (refrigerant) is started, to thereby start up the Rankine cycle device 2A.

Then, when the expander 23 is operated and starts to produce the drive force, some of the drive force produced in the expander 23 drives the pump 25A, and the remaining drive force is transmitted to the engine 10 via the transmission mechanism 3, to assist the output (drive force) of the engine 10.

Furthermore, when the operating condition of the Rankine cycle device 2A is not satisfied, the control unit 4 disengages (turns off) the electromagnetic clutch 34, to stop the circulation of the working fluid, to thereby stop the Rankine cycle device 2A.

The evaporator 22 may be a device that allows heat exchange between the working fluid of the Rankine cycle device 2A and exhaust of the engine 10 to occur. Alternatively, the evaporator 22 may be a device that allows heat exchange between the working fluid of the Rankine cycle device 2A and the cooling water of the engine 10, as well as the exhaust of the engine 10, to occur.

Furthermore, a bypass passage that circulates the working fluid bypassing the expander 23, and a bypass valve that opens and closes the bypass passage may be equipped, and immediately after the startup of the Rankine cycle device 2A in which the electromagnetic clutch 34 is engaged, the bypass valve may be maintained in a valve open state, to make the working fluid circulate while bypassing the expander 23. Then, after a pressure difference of the working fluid before and after passing through the expander 23 exceeds a threshold, that is, after the expander 23 starts to produce the drive force, the working fluid can be circulated through the expander 23 by closing the bypass valve.

According to such a configuration, since, immediately after the startup of the Rankine cycle device 2A, the working fluid flows while bypassing the expander 23, and an evaporating temperature of the working fluid decreases due to a decrease in a pressure in the evaporator 22, a startup performance of the Rankine cycle device 2A can be improved.

Figure 2:
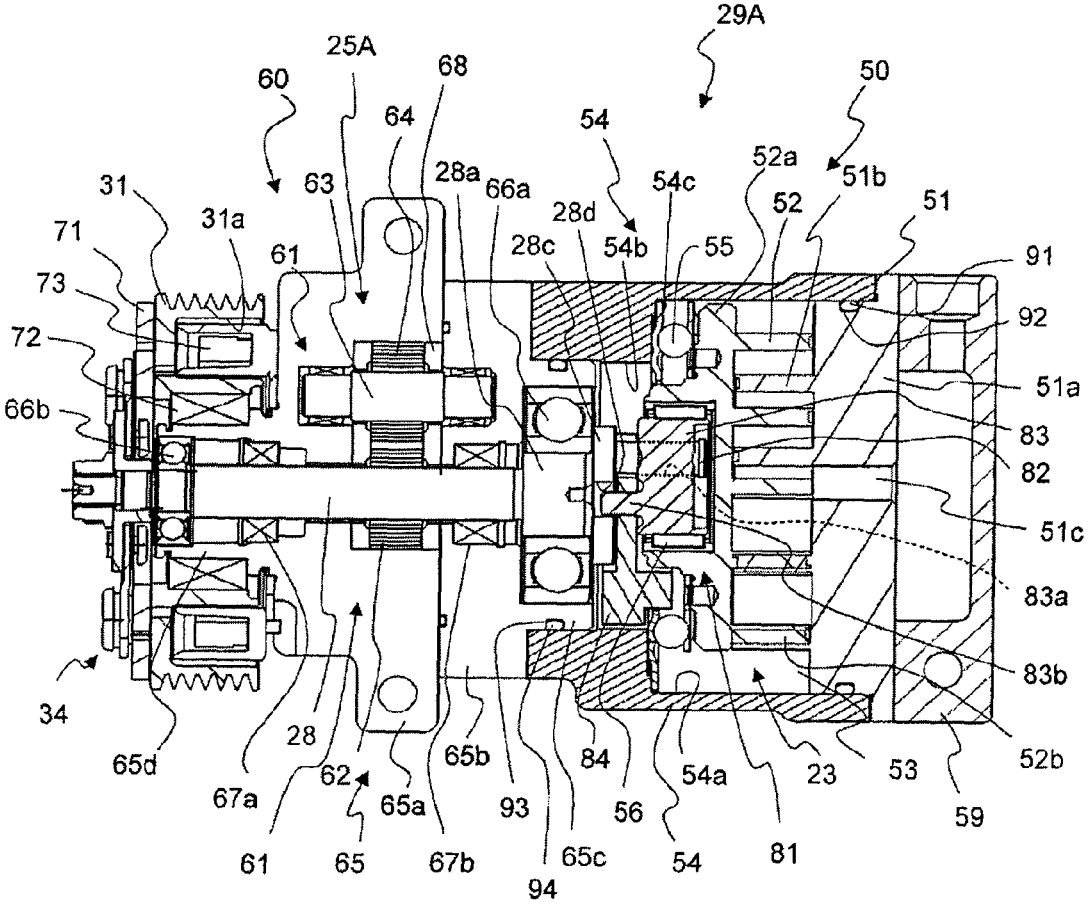
FIG. 2 is a cross-sectional view illustrating a pump integrated expander according to the first embodiment.

Next, the structure of the pump integrated expander 29A (fluid machine) will be described in detail with reference to FIGS. 2 and 3.

As described above, the pump integrated expander 29A is the fluid machine, in which the pump 25A (first rotating unit, first fluid unit) that circulates the working fluid of the Rankine cycle device 2A and the expander 23 (second rotating unit, second fluid unit) that produces a rotational drive force by expanding the working fluid, which is heated and vaporized in the evaporator 22 after being pumped by the pump 25A, are driven by the common rotating shaft 28. The pump integrated expander 29A includes the transmission mechanism 3 (power transmission unit) that transmits the drive force between the rotating shaft 28 and the crank shaft 10*a* of the engine 10.

The expander 23 part (expansion unit 50) of the pump integrated expander 29A includes a fixed scroll 51 disposed on one end, in the axial direction, of the pump integrated expander 29A, an orbiting scroll (rotating body) 52, and a casing member 54 defining a scroll receiving space 53.

The fixed scroll 51 includes a disc shape main body 51*a*, a scroll portion (volute body) 51*b* standing in a rib-like fashion on one end face of the main body 51*a*, and an inlet 51*c* for the working fluid, the inlet being formed to penetrate through the main body 51*a* near the shaft center thereof.

The casing member 54 is formed in a tubular shape with both ends opened. The casing member 54 includes therein a larger inner diameter portion 54*a* that fits on the outer periphery of the main body 51*a* of the fixed scroll 51, and a smaller inner diameter portion 54*b*, in which components on the pump 25A side fits. A space surrounded by the larger inner diameter portion 54*a* corresponds to the scroll receiving space 53.

On the outer peripheral portion of the main body 51*a* fitted in the larger inner diameter portion 54*a*, a groove 91 is disposed. To the groove 91, an O-ring (sealing member) 92 is attached. The O-ring 92 seals a fitting gap between the casing member 54 and the fixed scroll 51, to prevent leakage of the working fluid. As the sealing member for preventing the leakage of the working fluid from the fitted portion, for example, a lip packing, or the like, may be used instead of the O-ring 92. Similarly, the below-mentioned O-ring may be replaced with the lip packing, or the like.

The orbiting scroll 52 includes a disc shape main body 52*a* and a scroll portion (volute body) 52*b* standing in a rib-like fashion on one end face of the main body 52*a*.

In this case, between the opposite face of the end face to which the scroll portion 52*b* of the main body 52*a* is formed, and a step portion 54*c* formed between the larger inner diameter portion 54*a* and the smaller inner diameter portion 54*b* of the casing member 54, a ball coupling 55 is disposed. The orbiting scroll 52 moves with orbiting motion as the working fluid expands while the rotation of the orbiting scroll 52 is restricted by the ball coupling 55 (rotation restricting mechanism).

To an end face of the main body 52*a* of the orbiting scroll 52 on the ball coupling 55 side, a drive bearing 56 is disposed. Via an eccentric bush 83 that is fitted in the drive bearing 56, the orbiting motion of the orbiting scroll 52 orbiting around the rotating shaft 28 is transmitted as a rotational drive force of the rotating shaft 28.

As the pump 25A (pump unit 60) of the pump integrated expander 29A, a gear pump 61 is employed in the present embodiment. The gear pump 61 includes a driving gear (rotating body) 62 supported by the rotating shaft 28, a driven shaft 63 rotatably supported in parallel to the rotating shaft 28, a driven gear 64 supported by the driven shaft 63 and engaged with the driving gear 62, and a casing member 65 receiving the driving gear 62 and the driven gear 64.

In the present embodiment, although the gear pump 61 is employed as the pump 25A, a vane pump, or the like, may be used, and accordingly, the pump 25A is not limited to the gear pump 61.

The casing member 65 includes a first casing member 65*a* that is disposed on the pulley 31 side and defines a recessed receiving space 68 for the driving gear 62 and the driven gear 64, and a second casing member 65*b* that is disposed on the expander 23 side and joined to the first casing 65*a* to occlude the receiving space 68.

The first casing member 65*a* and the second casing member 65*b* rotatably support the driven shaft 63 of the gear pump 61 so that the driven shaft 63 is arranged laterally across the receiving space 68 in the axial direction.

On the expansion unit 50 side of the second casing member 65*b*, a tubular portion (fitted portion) 65*c*, which is fitted inside the smaller inner diameter portion 54*b* of the casing member 54, is integrally formed. In the tubular portion 65*c*, a ball bearing 66*a* that supports the larger diameter portion 28*a* of the main shaft 28 is disposed.

In this case, to a groove 93 disposed on an outer periphery of the tubular portion 65*c*, an O-ring (sealing member) 94 is attached. The O-ring 94 seals the fitting gap, to prevent the leakage of the working fluid.

Furthermore, on the both sides across the driving gear 62, shaft seals 67*a*, 67*b* are disposed to prevent the leakage of the working fluid from the gap between the rotating shaft 28 and the casing member 65.

To the rotating shaft 28 that extends outward penetrating through the first casing member 65*a*, the pulley 31 and the electromagnetic clutch 34, constituting the transmission mechanism 3, are disposed.

On an end face opposite to the expansion unit 50 side of the first casing member 65*a*, a tubular portion 65*d*, in which the rotating shaft 28 is included, is integrally formed. On a tip side inside the tubular portion 65*d*, a ball bearing 66*b* that supports the rotating shaft 28 in cooperation with the ball bearing 66*a*. On the bottom side (expansion unit 50 side) of the tubular portion 65*d*, the shaft seal 67*a* is disposed.

Then, a clutch plate 71 is attached to the tip of the rotating shaft 28 penetrating from the tubular portion 65*d*. On an outer periphery of the tubular portion 65*d*, the pulley 31 is rotatably attached via a bearing 72.

Furthermore, a clutch coil 73 is received in an annular groove 31*a*, that is formed on an end face of the pulley 31 on the expansion unit 50 side and centered around the rotating shaft 28. The electromagnetic clutch 34 includes the clutch plate 71 and the clutch coil 73.

In such a configuration, when the clutch coil 73 is energized, a magnetic attraction is produced, and accordingly, the clutch plate 71 comes into contact with the pulley 31, so that the pulley 31 and the clutch plate 71 (rotating shaft 28) move in association with each other. As a result, the drive force is transmitted between the pump integrated expander 29A (rotating shaft 28) and the engine 10 (crank shaft 10*a*).

Furthermore, to the rotating shaft (main shaft) 28 penetrating through the second casing 65*b* and extending to the expander 23 side, the orbiting scroll (rotating body) 52 is connected via a driven crank mechanism 81.

The driven crank mechanism 81 includes: a crankpin 82 that stands on an end face of a flange portion 28*c* (larger diameter portion) disposed on the larger diameter portion 28*a* of the rotating shaft (main shaft) 28 and disposed in parallel to the rotating shaft 28 and in a manner that the shaft center is off-centered with respect to the rotating shaft 28; and the eccentric bush 83 that includes a crankpin hole 83*a*, in which the crankpin 82 is fitted, and that is held in the drive bearing (bearing) 56 disposed in the orbiting scroll (rotating body) 52. The eccentric bush 83 is inserted in an oscillatable manner with respect to the crankpin 82, and configured so that orbiting motion of the crankpin 82 remains orbiting motion (revolving motion) of the eccentric bush 83.

In this case, while standing a crankpin in the eccentric bush 83, a crankpin hole, in which the crankpin disposed in the eccentric bush 83 is fitted, may be disposed in the larger diameter portion 28*a* of the rotating shaft 28.

Furthermore, a counterweight (balance weight) 84, that balances the eccentric bush 83 and the orbiting scroll 52, to suppress an occurrence of vibration in the expander 23, is secured to the eccentric bush 83 by caulking with a rivet, for example.

Still further, to restrict an orbiting radius of the orbiting scroll 52, a restriction hole 28*d* is disposed in the flange portion 28*c* of the rotating shaft 28, and a regulation protrusion 83*b* configured to fit in the restriction hole 28*d* is disposed in the eccentric bush 83. The engagement of the restriction hole 28*d* and the regulation protrusion 83*b* restricts the oscillation of the eccentric bush 83 oscillating around the crankpin 82.

As mentioned above, in the pump unit 60, the casing member 65 as the casing (first casing) supports the gear pump 61 (first rotating unit), the rotating shaft 28 and the driven crank mechanism 81. In the expansion unit 50, the casing (second casing) including the casing member 54 and a rear casing 59 supports the expander 23 (second rotating unit) including the fixed scroll 51 and the orbiting scroll 52.

Then, by fitting the tubular portion (fitted portion) 65*c* on the pump unit 60 side in the smaller inner diameter portion 54*b* on the expansion unit 50 side, the pump unit 60 and the expansion unit 50 are integrated, to constitute the pump integrated expander 29A (fluid machine).

Figure 3:
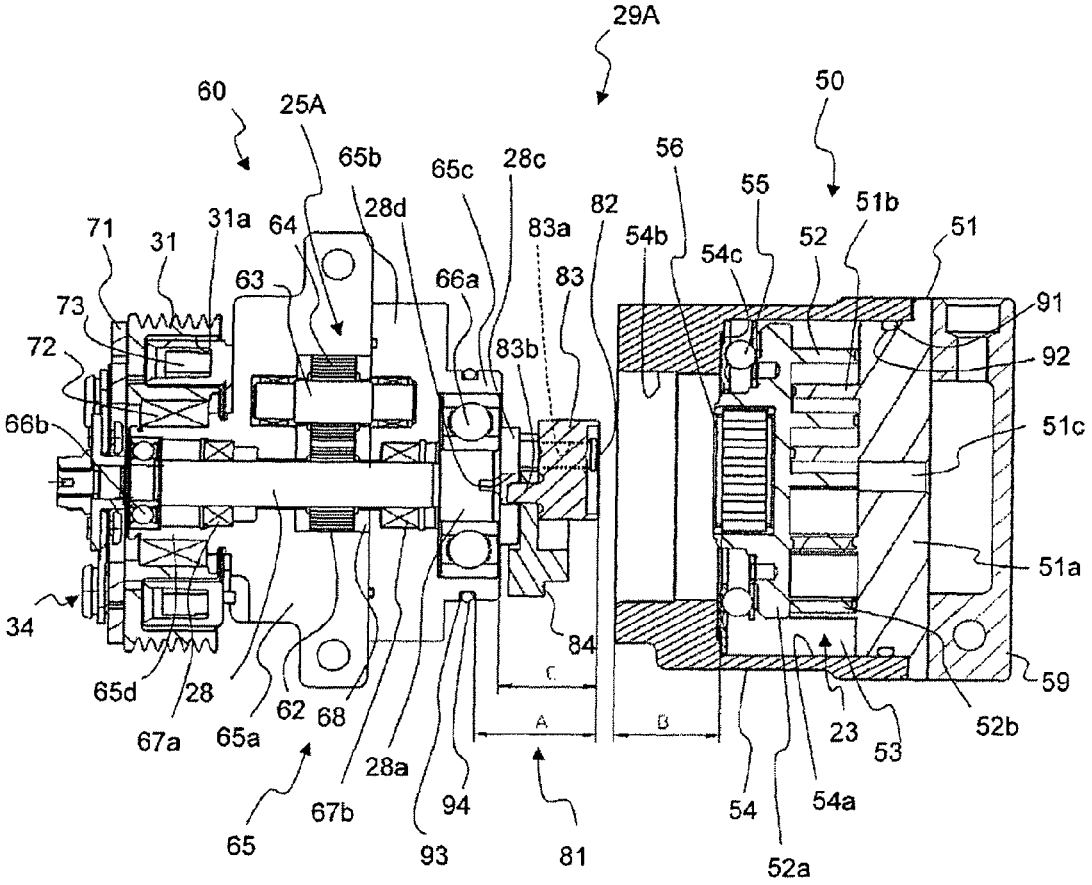
FIG. 3 is a cross-sectional view illustrating a separated state of the pump integrated expander according to the first embodiment.

That is, as illustrated in FIG. 3, the pump integrated expander 29A (fluid machine) can be divided into the pump unit 60 and the expansion unit 50, by separating at the fitted portion of the tubular portion (fitted portion) 65*c* on the pump unit 60 side and the smaller inner diameter portion 54*b* on the expansion unit 50 side, and by pulling the eccentric bush 83 out of the drive bearing 56.

Furthermore, by fitting the tubular portion (fitted portion) 65*c* on the pump unit 60 side in the smaller inner diameter portion 54*b* on the expansion unit 50 side while fitting the eccentric bush 83 in the drive bearing 56, the pump unit 60 and the expansion unit 50 are connected and integrated by the rotating shaft 28, to act as the pump integrated expander 29A (fluid machine).

Furthermore, as illustrated in FIG. 3, dimension of each component is set so that when a distance in the axial direction from a tip of the eccentric bush 83 on the expansion unit 50 side to the O-ring (sealing member) 94 attached to the tubular portion (fitted portion) 65*c* is denoted as A, a distance in the axial direction from an open end of the casing member 54 (second casing) on the pump unit 60 side to an edge of an opening of the drive bearing (bearing) 56 disposed on the orbiting scroll (rotating body) 52 is denoted as B, and a distance in the axial direction from the tip of the eccentric bush 83 on the expansion unit 50 side to a tip of the tubular portion (fitted portion) 65*c* is denoted as C, A>B>C is satisfied.

According to this pump integrated expander 29A (fluid machine), since the pump unit 60 (pump 25A) and the expansion unit 50 (expander 23) can be separated from each other, the operation evaluation (performance test) of the pump 25A and the operation evaluation (performance test) of the expander 23 can be performed individually.

Thus, for example, when a torque measurement of the expander 23 without loading is performed on the isolated expansion unit 50 separated from the pump unit 60, measurement accuracy of the torque can be improved.

In addition, when a problem occurs in the pump integrated expander 29A, it is possible to identify whether the pump unit 60 or the expansion unit 50 includes the problem by individually performing the operation evaluation. Thus, for example, it is possible to replace only a unit in which the problem occurs, and thus, production efficiency and maintainability of the pump integrated expander 29A can be improved.

Furthermore, for example, when the pump unit 60 and the expansion unit 50 are separated from each other at a coupled portion disposed partway along the rotating shaft 28, it is necessary to provide an additional bearing for the rotating shaft 28 on the expansion unit 50 side, and accordingly, the length of the pump integrated expander 29A (fluid machine) in the axial direction might be increased, and the number of components and the number of man hours needed to process and assemble the machine might be increased, to cause an increase in production cost.

In contrast, in the above-mentioned pump integrated expander 29A, since the pump unit 60 including the driven crank mechanism 81 and the rotating shaft 28 (main shaft), and the expansion unit 50 can be separated from each other, it is not necessary to provide a bearing for supporting the rotating shaft 28 (main shaft) on the side of expansion unit 50, that is configured to be separated.

Therefore, the length of the pump integrated expander 29A (fluid machine) in the axial direction can be shortened, and the number of components and the number of man hours needed to process and assemble the machine can be decreased, and accordingly, the production cost can be suppressed at a minimum.

Furthermore, in the above-mentioned pump integrated expander 29A, by setting the distances A, B and C to satisfy the relationship of A>B>C, workability in the assembly process for integrating the pump unit 60 and the expansion unit 50 can be improved.

That is, in the pump integrated expander 29A that satisfies A>B>C, when the pump unit 60 and the expansion unit 50 are integrated, because of B>C, the fitting of the tubular portion (fitted portion) 65*c* on the pump unit 60 side and the smaller inner diameter portion 54*b* of the expansion unit 50 side starts before the fitting of the eccentric bush 83 in the drive bearing 56 starts.

Thus, positioning of the eccentric bush 83 and the drive bearing 56 can be performed in a state in which a location of the pump unit 60 in the axial direction with respect to the expansion unit 50 has been decided, and when the tubular portion 65*c* on the pump unit 60 side is rotated with respect to the smaller inner diameter portion 54*b* on the expansion unit 50 side, the orbiting radius of the eccentric bush 83 with respect to the rotating shaft 28 (main shaft) can be changed. As a result, the eccentric bush 83 can be easily fitted in the drive bearing 56.

In contrast, when it is set that the fitting of the eccentric bush 83 in the drive bearing 56 starts before fitting the tubular portion (fitted portion) 65*c* on the pump unit 60 side and the smaller inner diameter portion 54*b* on the expansion unit 50 side, that is, when B<C, it is necessary to perform the positioning of the eccentric bush 83 and the drive bearing 56 while aligning the expansion unit 50 and the pump unit 60. This may make the fitting process of the eccentric bush 83 in the drive bearing 56 difficult.

In this case, difference between the orbiting radius of the orbiting scroll 52 and the orbiting radius of the driven crank mechanism 81 can be absorbed in an allowable width of orbiting radius produced by a gap (looseness) between the regulation protrusion 83*b* and the restriction hole 28*d* and by the rotation of the eccentric bush 83 about the crankpin 82.

Figure 6:
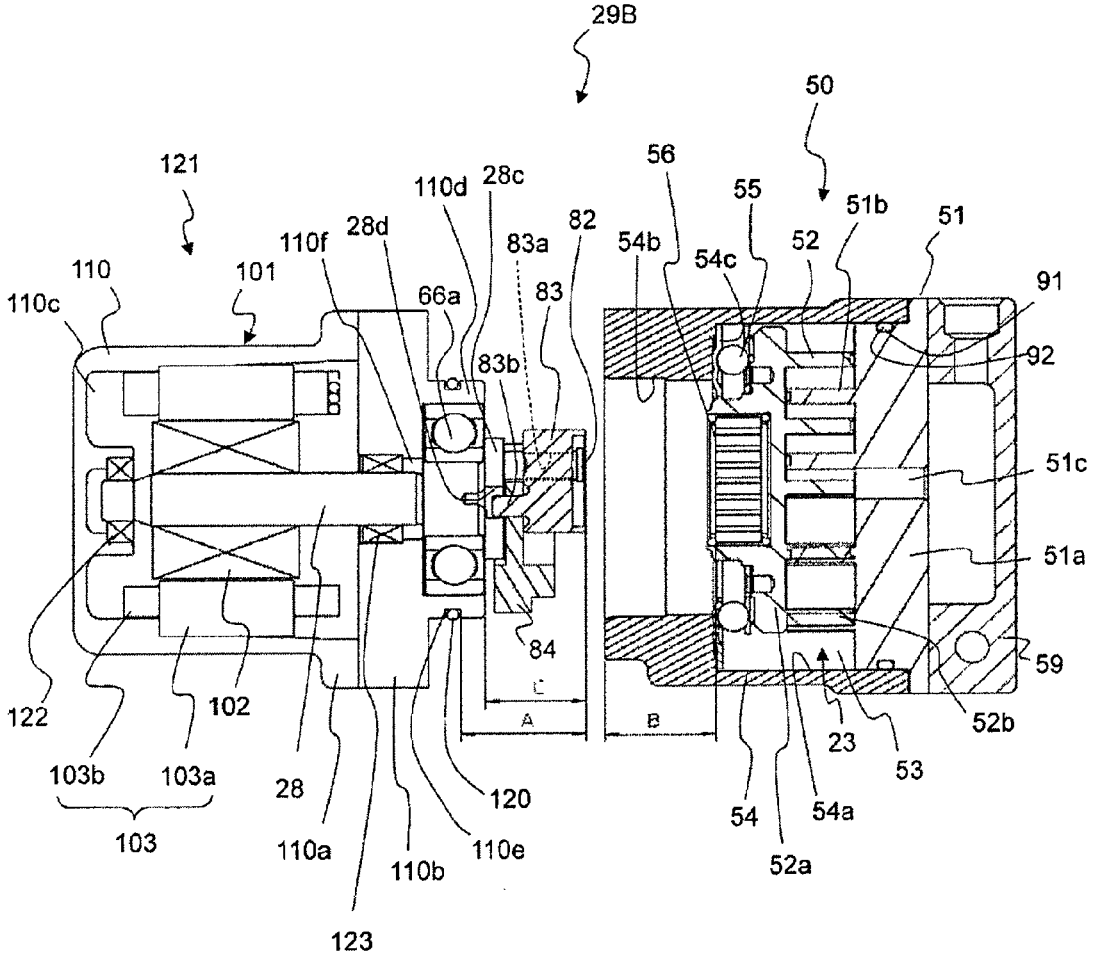
FIG. 6 is a cross-sectional view illustrating a separated state of the generator integrated expander according to the second embodiment.

Although, as described above, according to the present embodiment, the rotation of the eccentric bush 83 about the crankpin 82 and the looseness of the regulation protrusion 83*b* and the restriction hole 28*d* absorb the difference between the orbiting radius of the orbiting scroll 52 and the orbiting radius of the driven crank mechanism 81, a slider-type driven crank mechanism, in which both of the crankpin 82 and the crankpin hole 83*a* disposed in the eccentric bush 83 are in a rectangular shape and the eccentric bush 83 is inserted in a slidable fashion in the axial direction with respect to the crankpin 82, to absorb the difference of the orbiting radius, may be used (see, for example, FIG. 6 of Japanese Laid-open Patent Application Publication No. 2006-342793).

Furthermore, because of B>C and A>B in the above-mentioned pump integrated expander 29A, when integrating the pump unit 60 and the expansion unit 50, the eccentric bush 83 starts to fit in the drive bearing 56, and then, the O-ring 94 starts to fit in the smaller inner diameter portion 54*b*.

Thus, by the fitting of the O-ring 94 and the smaller inner diameter portion 54*b*, the positioning of the eccentric bush 83 and the drive bearing 56 can be performed before a relative movement between the pump unit 60 and the expansion unit 50 starts to be restricted, and thus, the positioning can be easily performed.

In contrast, when the O-ring 94 starts to fit in the smaller inner diameter portion 54*b* before the eccentric bush 83 starts to fit in the drive bearing 56, that is, when B>A, it may be difficult to move the pump unit 60 with respect to the expansion unit 50, and accordingly, it may be difficult to perform the positioning of the eccentric bush 83 and the drive bearing 56.

Thus, in the above-mentioned pump integrated expander 29A that satisfies A>B>C, when the pump unit 60 and the expansion unit 50 are integrated, the eccentric bush 83 can be easily fitted in the drive bearing 56, and accordingly, workability of the integrating process can be improved.

Next, a second embodiment of the present invention will be described.

Figure 4:
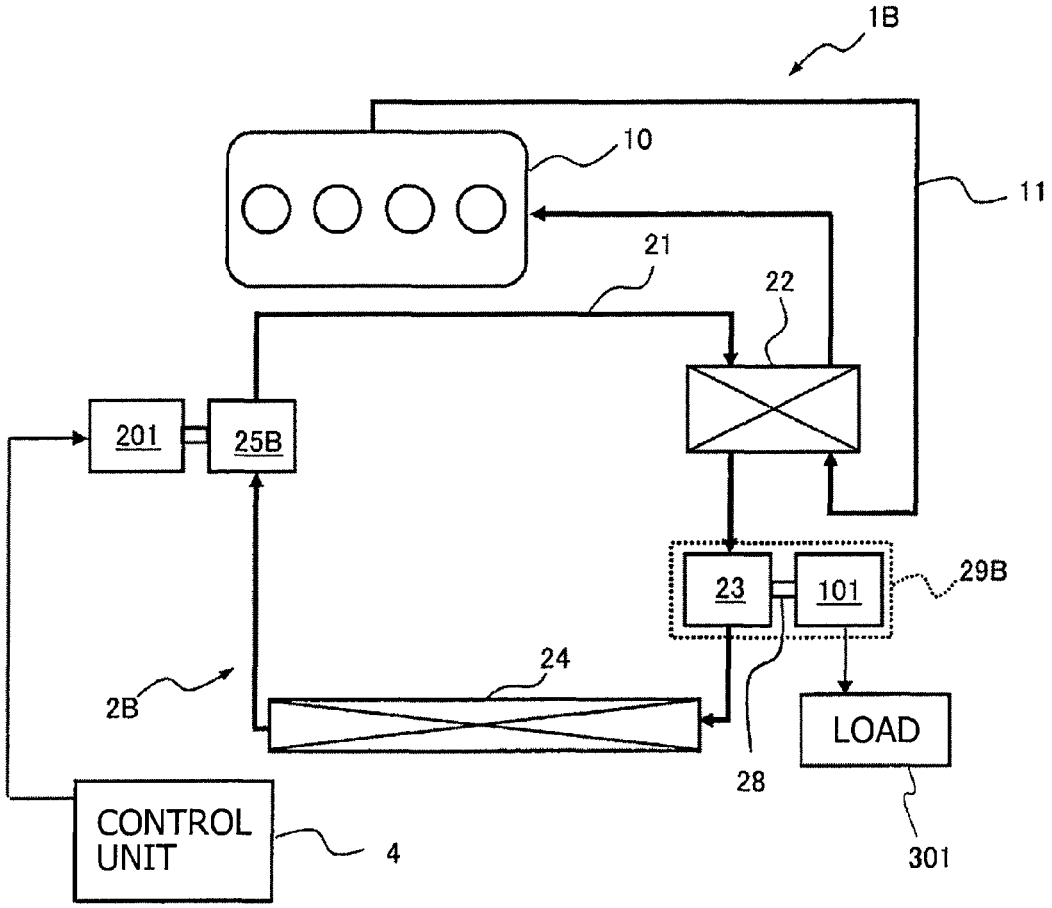
FIG. 4 is a view illustrating a schematic configuration of a waste-heat reusing device according to a second embodiment of the present invention.

FIG. 4 illustrates a configuration of a waste-heat reusing device 1B, into which a fluid machine according to a second embodiment of the present invention is incorporated.

The above-mentioned waste-heat reusing device 1A according to the first embodiment is a waste-heat reusing device that uses the pump integrated expander 29A (fluid machine), and drives the pump 25A, that circulates the working fluid (refrigerant) of the Rankine cycle device 2A, by the drive force produced by the expander 23, while assisting the output of the engine 10 by the drive force produced by the expander 23.

In contrast, the waste-heat reusing device 1B according to the second embodiment as illustrated in FIG. 4 is a device that drives a generator 101 by the drive force produced by the expander 23, to convert the waste heat of the engine 10 to an electric energy, so as to use the energy. In FIG. 4, elements the same as those shown in FIG. 1 are denoted by the same reference symbols, and functions of the same elements are similar to those in the first embodiment.

In FIG. 4, the waste-heat reusing device 1B includes a Rankine cycle device 2B, a generator 101 that is driven by an output of the Rankine cycle device 2B, and a control unit 4.

The Rankine cycle device 2B includes a circulation passage 21 that circulates working fluid (refrigerant). In the circulation passage 21, an evaporator 22, an expander 23, a condenser 24 and a pump 25B are disposed in this order along a flow direction of the working fluid.

The evaporator 22 allows heat exchange between high-temperature cooling water in a cooling water circulation passage 11 of an engine 10 (or exhaust of the engine 10) and the working fluid of the Rankine cycle device 2B to occur, to heat and evaporate (vaporize) the working fluid of the Rankine cycle device 2B.

The expander 23 is a scroll type expander that expands the working fluid vapor vaporized in the evaporator 22, to produce a drive force.

The condenser 24 allows heat exchange between the working fluid which has passed through the expander 23 and air outside to occur, to cool and condense (liquefy) the working fluid.

The pump 25B is an electric pump that is driven by a drive unit 201 including an electric motor, for example, and the pump 25B sends the working fluid liquefied in the condenser 24 to the evaporator 22.

As the pump 25B, a known pump, such as a gear pump, a vane pump, or the like, may be appropriately employed.

Furthermore, instead of the electric pump 25B, a mechanical pump driven by a crank shaft of the engine 10 may be provided, and transmission of the drive force from the engine 10 to the mechanical pump may be controlled by an electromagnetic clutch, or the like, similarly to the first embodiment.

The control unit 4 is a device that drives and stops the pump 25B. When the pump 25B is the electric pump that is driven by the drive unit 201 including the electric motor (motor), the drive and stop of the pump 25B are controlled by controlling energization of the electric motor. Furthermore, when the mechanical pump driven by the engine 10 is used, the control unit 4 controls turn-on and turns-off of the electromagnetic clutch incorporated in a transmission mechanism that transmits the drive force from the engine 10 to the mechanical pump, to control the drive and stop of the pump.

In this case, the expander 23 and the generator 101 are connected and integrated by a rotating shaft 28, to provide a generator integrated expander 29B (fluid machine). That is, the rotating shaft 28 of the generator integrated expander 29B acts as an output shaft of the expander 23 and an input shaft of the generator 101.

Then, the Rankine cycle device 2B is started up by starting the circulation of the working fluid by the pump 25B, and then, when the expander 23 (expansion unit in the generator integrated expander 29B) starts to produce a drive force, the drive force output by the expander 23 drives the generator 101, so that the generator 101 generates electricity.

The generator 101 supplies the generated electricity to a load 301. The load 301 may be an in-vehicle battery, the electric motor (motor) that generates a drive force of vehicle (assisting force of the engine 10), or the like. The waste-heat reusing device 1B is a device that converts the waste heat of the engine 10 to the electric energy, to use the energy.

A bypass passage that circulates the working fluid bypassing the expander 23, and a bypass valve that opens and closes the bypass passage may be equipped.

Figure 5:
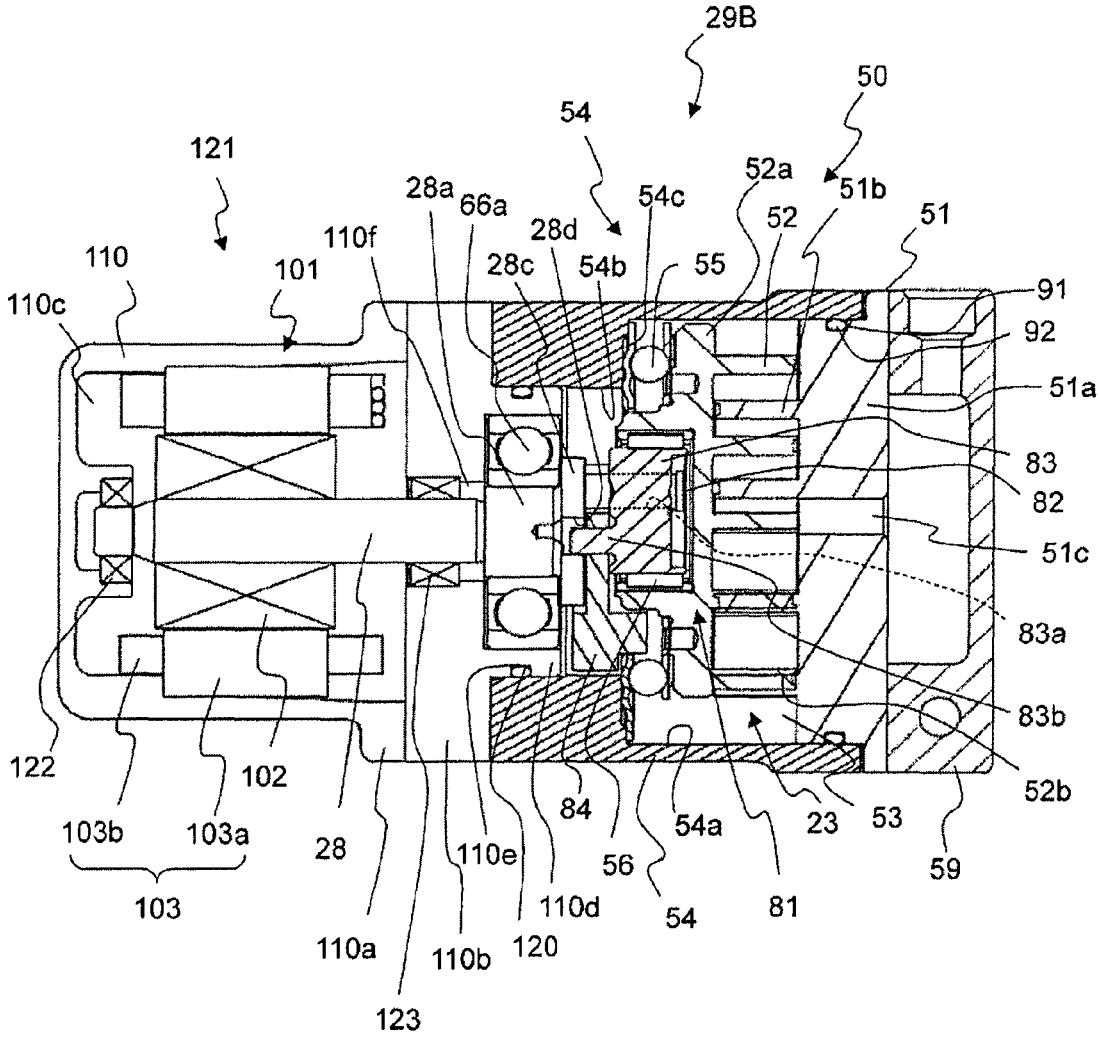
FIG. 5 is a cross-sectional view illustrating a generator integrated expander according to the second embodiment.

Next, the structure of the generator integrated expander 29B (fluid machine) will be described in detail with reference to FIGS. 5 and 6.

The expander 23 part (expansion unit 50) of the generator integrated expander 29B includes, similarly to the first embodiment, a fixed scroll 51 disposed on one end, in the axial direction, of the generator integrated expander 29B, an orbiting scroll (rotating body) 52, and a casing member 54 defining a scroll receiving space 53.

In contrast, the generator 101 part (power generating unit 121) of the generator integrated expander 29B includes the generator 101 and a casing member 110 that supports the generator 101.

The generator 101 includes: a rotor 102 that is secured on a portion of the rotating shaft 28 extending in the casing member 110 and that includes a permanent magnet, for example; and a stator 103 that is secured on an inner peripheral surface of the casing member 110 with the rotator 102 surrounded.

The stator 103 includes a yoke 103*a* and, for example, three pairs of coils 103*b* wound around the yoke 103*a*. The coils 103*b* generate a three-phase alternating current as the rotor 102 rotates, to supply the alternating current to the external load 301.

The power generating unit 121 may be a direct-current generator.

The casing member 110 includes a bottomed tubular first casing member 110*a* that defines a space 110*c* for receiving the rotor 102, the stator 103, and the like, and a second casing member 110*b* that is joined to the first casing member 110*a* to occlude the space 110*c*.

On the expansion unit 50 side of the second casing member 110*b*, a tubular portion (fitted portion) 110*d*, that is fitted inside a smaller inner diameter portion 54*b* of the casing member 54 of the expansion unit 50, is integrally formed. In the tubular portion 110*d*, a ball bearing 66*a* that supports a larger diameter portion 28*a* of the main shaft 28 is disposed.

In this case, to a groove 110*e* disposed on an outer periphery of the tubular portion 110*d*, an O-ring (sealing member) 120 is attached. The O-ring 120 seals the fitting gap, to prevent the leakage of the working fluid.

Furthermore, on the bottom of the first casing member 110*a*, a ball bearing 122 that rotatably supports an end of the rotating shaft 28 is disposed. On a generator 101-side end of a through hole 110*f* of the second casing member 110*b*, through which hole the rotating shaft 28 is inserted, a shaft seal 123 is disposed.

Still further, to the rotating shaft (main shaft) 28, the orbiting scroll (rotating body) 52 is connected via a driven crank mechanism 81.

The driven crank mechanism 81 includes, similarly to the first embodiment: a crankpin 82 that stands on an end face of a flange portion 28*c* (larger diameter portion) disposed on the larger diameter portion 28*a* of the rotating shaft (main shaft) 28 and disposed in parallel to the rotating shaft 28 and in a manner that the shaft center is off-centered with respect to the rotating shaft 28; and an eccentric bush 83 that includes a crankpin hole 83*a*, in which the crankpin 82 is fitted, and that is held in a drive bearing (bearing) 56 disposed in the orbiting scroll (rotating body) 52. The eccentric bush 83 is inserted in an oscillatable manner with respect to the crankpin 82.

In this case, while standing a crankpin in the eccentric bush 83, a crankpin hole, in which the crankpin disposed in the eccentric bush 83 is fitted, may be disposed in the larger diameter portion 28*a* of the rotating shaft 28.

Furthermore, a counterweight (balance weight) 84 is secured to the eccentric bush 83 by caulking with a rivet, for example. Still further, a restriction hole 28*d* is disposed in the flange portion 28*c* of the rotating shaft 28, and a regulation protrusion 83*b* configured to fit in the restriction hole 28*d* is disposed in the eccentric bush 83.

As mentioned above, in the power generating unit 121, the casing member 110 as the casing (first casing) supports the generator 101 (first rotating unit), the rotating shaft 28 and the driven crank mechanism 81. In the expansion unit 50, the casing (second casing) including the casing member 54 and a rear casing 59 supports the expander 23 (second rotating unit) including the fixed scroll 51 and the orbiting scroll 52.

Then, by fitting the tubular portion (fitted portion) 110*d* on the power generating unit 121 side and the smaller inner diameter portion 54*b* on the expansion unit 50 side, the power generating unit 121 and the expansion unit 50 are connected and integrated via the rotating shaft 28, to constitute the generator integrated expander 29B (fluid machine).

That is, as illustrated in FIG. 6, the generator integrated expander 29B (fluid machine) can be divided into the power generating unit 121 and the expansion unit 50, by separating at the fitted portion of the tubular portion (fitted portion) 110*d* on the power generating unit 121 side and the smaller inner diameter portion 54*b* on the expansion unit 50 side, and by pulling the eccentric bush 83 out of the drive bearing 56.

Furthermore, by fitting the tubular portion (fitted portion) 110*d* on the power generating unit 121 side in the smaller inner diameter portion 54*b* on the expansion unit 50 side while fitting the eccentric bush 83 in the drive bearing 56, the power generating unit 121 and the expansion unit 50 are connected and integrated by the rotating shaft 28, to act as the generator integrated expander 29B (fluid machine).

Furthermore, as illustrated in FIG. 6, dimension of each component is set so that when a distance in the axial direction from a tip of the eccentric bush 83 on the expansion unit 50 side to the O-ring (sealing member) 120 attached to the tubular portion (fitted portion) 110*d* is denoted as A, a distance in the axial direction from an open end of the casing member 54 (second casing) on the power generating unit 121 side to an edge of an opening of the drive bearing (bearing) 56 disposed on the orbiting scroll (rotating body) 52 is denoted as B, and a distance in the axial direction from the tip of the eccentric bush 83 on the expansion unit 50 side to a tip of the tubular portion (fitted portion) 110*d* is denoted as C, A>B>C is satisfied.

According to this generator integrated expander 29B (fluid machine), almost the same functions and advantageous effects as those of the pump integrated expander 29A according to the first embodiment can be achieved.

That is, since the power generating unit 121 and the expansion unit 50 can be separated from each other, the operation evaluation (performance test) of the generator 101 and the operation evaluation (performance test) of the expander 23 can be performed individually. In addition, when a problem occurs in the generator integrated expander 29B, it is possible to identify whether the power generating unit 121 or the expansion unit 50 includes the problem.

Furthermore, difference between the orbiting radius of the orbiting scroll 52 and the orbiting radius of the driven crank mechanism 81 can be absorbed in an allowable width of orbiting radius produced by a gap (looseness) between the regulation protrusion 83*b* and the restriction hole 28*d* and by the oscillation of the eccentric bush 83 with respect to the crankpin 82. Similarly to the first embodiment, a slider-type driven crank mechanism that absorbs the difference of the orbiting radius may be employed.

Furthermore, in the above-mentioned generator integrated expander 29B, since the power generating unit 121 including the driven crank mechanism 81 and the rotating shaft 28 (main shaft), and the expansion unit 50 can be separated from each other, it is not necessary to provide a bearing for supporting the rotating shaft 28 (main shaft) on the side of expansion unit 50, that is configured to be separated.

Therefore, the length of the generator integrated expander 29B (fluid machine) in the axial direction can be shortened, and the number of components and the number of man hours needed to process and assemble the machine can be decreased, and accordingly, the production cost can be suppressed at a minimum.

Furthermore, in the above-mentioned generator integrated expander 29B, by setting the distances A, B and C to satisfy the relationship of A>B>C, workability in the assembly process for integrating the power generating unit 121 and the expansion unit 50 can be improved.

That is, in the generator integrated expander 29B that satisfies A>B>C, when the power generating unit 121 and the expansion unit 50 are integrated, the fitting of the tubular portion (fitted portion) 110*d* on the power generating unit 121 side and the smaller inner diameter portion 54*b* of the expansion unit 50 side starts before the fitting of the eccentric bush 83 in the drive bearing 56 starts.

Thus, positioning of the eccentric bush 83 and the drive bearing 56 can be performed in a state in which a location of the power generating unit 121 in the axial direction with respect to the expansion unit 50 has been decided, and accordingly, the eccentric bush 83 can be easily fitted in the drive bearing 56.

Furthermore, in the above-mentioned generator integrated expander 29B that satisfies A>B>C, when integrating the power generating unit 121 and the expansion unit 50, the eccentric bush 83 starts to fit in the drive bearing 56, and then, the O-ring 120 starts to fit in the smaller inner diameter portion 54*b*.

Thus, by the fitting of the O-ring 120 and the smaller inner diameter portion 54*b*, the positioning of the eccentric bush 83 and the drive bearing 56 can be performed before a relative movement between the power generating unit 121 and the expansion unit 50 starts to be restricted, and thus, the positioning can be easily performed.

Thus, in the above-mentioned generator integrated expander 29B that satisfies A>B>C, the eccentric bush 83 can be easily fitted in the drive bearing 56, and accordingly, workability of the integrating process of the power generating unit 121 and the expansion unit 50 can be improved.

Although in the above description, the details of the present invention are specifically described referring to the preferred embodiments, it is obvious for one skilled in the art that various modifications can be made on the basis of the basic technical concept and teachings of the present invention.

For example, a fluid machine, that integrally includes a scroll type expansion unit, a power generating unit and a pump unit by connected them by a common rotating shaft, may be adopted. Furthermore, the power generating unit may be a motor generator that has a motor function as well as a generator function.

Furthermore, the second rotating unit that includes the rotating body connected to the main shaft via the driven crank mechanism is not limited to the scroll type expander, and may be a scroll type compressor. Still further, the rotating body in the second rotating unit is not limited to the orbiting scroll (oscillating scroll), and may be an eccentric rotary piston, or the like.

For example, in a fluid machine that integrally includes a compressor (compressor unit; second rotating unit) including an eccentric rotary piston mechanism, and a motor (electric motor unit; second rotating unit), as disclosed in Japanese Laid-open Patent Application Publication No. 2011-032958, the separable structure according to the embodiments of the present invention can be applied. In this case, the eccentric rotary piston corresponds to the rotating body connected to the main shaft via the driven crank mechanism.

REFERENCE SIGNS LIST

1A, 1B Waste-heat reusing device
2A, 2B Rankine cycle device
10 Engine
21 Circulation passage
22 Evaporator
23 Expander (second rotating unit)
24 Condenser
25A Pump (first rotating unit)
25B Pump
28 Rotating shaft (main shaft)
28*a* Larger diameter portion
28*c* Flange portion 28*c*
29A Pump integrated expander (fluid machine)
29B Generator integrated expander (fluid machine)
50 Expansion unit
51 Fixed scroll
51*a* Main body (second casing)
52 Orbiting scroll (rotating body)
54 Casing member (second casing)
60 Pump unit
65 Casing member (first casing)
65*c*, 110*d* Tubular portion (fitted portion)
81 Driven crank mechanism
82 Crankpin
83 Eccentric bush
83*a* Crankpin hole
94, 120 O-ring (sealing member)
101 Generator
121 Power generating unit (first rotating unit)

The invention claimed is:

1. A fluid machine comprising:

a first rotating unit that rotates about a main shaft;

a second rotating unit that includes a fixed scroll, an orbiting scroll and a rotation restricting mechanism; and a driven crank mechanism comprising a crankpin that is eccentrically disposed with respect to a larger diameter portion of the main shaft, and an eccentric bush that is inserted in an oscillatable manner with respect to the crankpin and held by a bearing which is disposed on the orbiting scroll, the driven crank converting between rotational motion of the main shaft and orbiting motion of the orbiting scroll and being capable of changing an orbiting radius of the orbiting scroll, wherein a first casing including a bearing which supports the larger diameter portion of the main shaft, supports the first rotating unit and supports the driven crank mechanism via the main shaft, wherein a second casing supports the second rotating unit, wherein the first casing and the second casing are capable of being separated from each other, wherein an outer periphery of a fitted portion of the first casing is fitted inside an open end of the second casing, to connect the first casing and the second casing, and a fitting gap between the first casing and the second casing is sealed with a sealing member disposed on the outer periphery of the fitted portion of the first casing, and wherein when a distance in an axial direction from a tip of the eccentric bush to the sealing member is denoted as A, a distance in the axial direction from an open end edge of the second casing to an end edge of an opening of the bearing of the orbiting scroll is denoted as B, and a distance in the axial direction from the tip of the eccentric bush to a tip of the fitted portion of the first casing is denoted as C, A>B>C is satisfied.

2. The fluid machine according to claim 1, wherein the second rotating unit is a scroll type expander and the first rotating unit is a pump unit.

3. The fluid machine according to claim 1, wherein the second rotating unit is a scroll type expander and the first rotating unit is a power generating unit.

* * * * *